United States Patent [19]

Koyama et al.

[11] 4,008,304

[45] Feb. 15, 1977

[54] PROCESS FOR PRODUCING CURED PHENOLIC FILAMENTS HAVING IMPROVED DRAWABILITY

[75] Inventors: Hiroaki Koyama, Osaka; Isao Kimura, Suita, both of Japan

[73] Assignee: Nippon Kynol Incorporated, Osaka, Japan

[22] Filed: Apr. 16, 1975

[21] Appl. No.: 568,462

Related U.S. Application Data

[63] Continuation of Ser. No. 331,811, Feb. 12, 1973, abandoned.

[30] Foreign Application Priority Data

Feb. 23, 1972 Japan ..... 47-18788

[52] U.S. Cl. ..... 264/236; 8/130.1; 264/343

[51] Int. Cl.[2] ..... B29C 25/00

[58] Field of Search ..... 264/210 F, 176 F; 260/841; 8/130.1

[56] References Cited

UNITED STATES PATENTS

| | | | |
|---|---|---|---|
| 2,071,250 | 2/1937 | Carothers | 260/78 |
| 2,249,756 | 7/1941 | Finzel | 264/210 F |
| 2,484,523 | 10/1949 | McClellan | 264/210 F |
| 3,651,199 | 3/1972 | Blume et al. | 264/236 |
| 3,716,521 | 2/1973 | Economy et al. | 264/176 F |
| 3,723,588 | 3/1973 | Economy et al. | 264/176 F |
| 3,808,289 | 4/1974 | Okuhashi et al. | 260/841 |
| 3,848,044 | 11/1974 | Hagiwara et al. | 260/841 |
| 3,884,754 | 5/1975 | Kimura et al. | 264/176 F |
| 3,887,747 | 6/1975 | Tamura et al. | 264/176 F |

*Primary Examiner*—Jay H. Woo

*Attorney, Agent, or Firm*—Sherman & Shalloway

[57] ABSTRACT

A process for producing cured phenolic filaments having improved drawability which comprises contacting cured phenolic filaments with a liquid or vapor having a concentration of at least 25 % by weight of a treating reagent selected from the group consisting of an alcohol of from 1 to 6 carbon atoms, acetone and mixture thereof.

4 Claims, No Drawings

PROCESS FOR PRODUCING CURED PHENOLIC FILAMENTS HAVING IMPROVED DRAWABILITY

This is a continuation, of Application Ser. No. 331,811, filed Feb. 12, 1973, now abandoned.

This invention relates to cured phenolic filaments having improved drawability in which the elongation of the filaments is great and the variance thereof (rate of fluctuation of elongation) is small, as well as in which such properties as dyeability, bleachability and tenacity have been improved and the discoloration is small.

More particularly, the present invention relates to a process for producing cured phenolic filaments which comprises contacting cured phenolic filaments with a liquid or vapor having a concentration of at least 25% by weight of a treating reagent selected from the group consisting of an alcohol of from 1 to 6 carbon atoms, acetone and a mixture thereof.

The drawn or undrawn phenolic filaments obtained by melt-spinning the fiber-forming uncured phenolic resin derived from the phenols and aldehydes and curing the resulting filaments not only have a high carbon content but possess a three-dimensional cross-linked structure. As a result, these filaments excel in flame-resistant and antifusing properties.

The conventional cured phenolic filaments, though possessing a tenacity and elongation as to be of practical use, had the drawback that their variance of elongation was great. Hence, as a practical matter, difficulty was experienced in obtaining filaments of still greater tenacity by drawing these filaments. As a result of researches, which were furnished with a view to overcoming this difficulty, it was found that the drawability could be improved immensely by treating the cured phenolic filaments with a reagent selected from the group consisting of an alcohol of from 1 to 6 carbon atoms, acetone and a mixture thereof. It was additionally found that an improvement of about 2 – 5 times that of the case where the cured phenolic filaments were not treated with the foregoing treating reagent could be obtained and further that the variance of the elongation was small and the elongation operation could be carried out exceedingly smoothly. In addition, it was found that various further advantages were had, as compared with the filaments not submitted to the foregoing treatment. The treated filaments were much more readily acetylated. Again, it was possible to impart crimpability to the filaments, and there was an improvement in the dyeability of the filaments.

It is therefore an object of the present invention to provide a process for the production of cured phenolic filaments wherein the foregoing improvements and advantages have been achieved.

Other objects and advantages of the invention will become apparent from the following description.

In the invention process, the treating reagent to be contacted with the cured phenolic filaments is composed of not less than 50% by weight based on the total weight of the filaments of a phenolic resin, preferably a novolak resin, and 0 – 50% by weight based on the total weight of the filaments of a fiber-forming thermoplastic synthetic resin.

The novolak resin, which is uncured and fusible in the starting molten mixture, can be cured with a curing reagent after melt-spinning. The method of preparing the novolak resin is well known per se. It can be produced by heat-reacting (polycondensing) a phenol with an aldehyde in the presence of an acid catalyst. The novolak resins usually have a number average molecular weight of about 300 to 2,000. If desired, those having a larger molecular weight (e.g. up to about 5,000) can be produced. Therefore, as is well known, the predominantly novolak-type modified novolak resins obtained by any desired combination of the novolak-type reaction and the resol-type reaction can also be used. Furthermore, any desired combinations of phenols and aldehydes can be used, and different novolak resins each derived from different combinations of phenols and aldehydes can be used conjointly.

The phenols used for producing the novolak resins are most commonly phenol and cresol, but other phenols can also be used. As examples of usable phenols, included are such as phenol, o-cresol, m-cresol, p-cresol, 2,3-xylenol, 2,5-xylenol, 2,4-xylenol, 2,6-xylenol, 3,4-xylenol, 3,5-xylenol, o-ethylphenol, m-ethylphenol, p-ethylphenol, p-phenylphenyl, p-tertiary butyl phenol, p-tertiary amylphenol, bisphenol A, resorcinol, and the mixtures of two or more of these.

The aldehyde most commonly used for the polycondensation with the foregoing phenols is formaldehyde, but para-formaldehyde, benzaldehyde, hexamethylenetetramine, and furfural, as well as mixtures thereof can also be utilized. These aldehydes can be used as a curing reagent in this invention.

The acid catalyst used for the reaction of forming the novolak resins may be any known organic or inorganic acids such, for example, as hydrochloric acid, nitric acid, sulfuric acid, phosphoric acid, formic acid, acetic acid, oxalic acid and phthalic acid.

As the fiber-forming thermoplastic synthetic resin, which can be admixed with the uncured novolak resin, usable are the polyamides such as nylon-6, nylon-7, nylon-9, nylon-11, nylon-12, nylon-66, nylon-610, nylon-611, nylon-612 and nylon-6T of the general formula

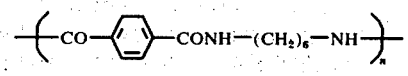

or nylon-11T of the formula

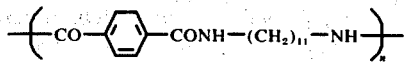

and the copolymers consisting essentially of these polyamides; the polyesters such as polymethylene terephthalate, polyethylene terephthalate, polybutylene terephthalate, polyethylene oxyterephthalate, polycyclohexylene terephthalate and the like, and the copolymers consisting essentially of these polyesters; the polyolefins such as polyethylene, polypropylene, polystyrene, polyvinylidene chloride, polyvinyl chloride and the like, and the copolymers thereof; and the various polyurethanes. These thermoplastic polymers may also be used in combination of two or more.

The uncured melt-spun filaments obtained by melt-spinning an uncured novolak resin which may contain a fiber-forming thermoplastic synthetic resin are cured by contacting the filaments with an aldehyde as a curing reagent in the presence of an acid catalyst and/or basic catalyst at a temperature from room temperature to 250° C. The contact between the filament and the curing reagent in the presence of the catalyst may be carried out by immersing the uncured melt-spun filaments in a bath containing the curing agent and the catalyst, or by spraying or fuming an aqueous solution of the curing reagent and the catalyst on the uncured melt-spun filaments. The contact may also be effected by contacting the filaments with a gaseous mixture of the curing reagent and the catalyst.

One example of the aqueous solution of a mixture of the aldehyde and an acid catalyst is that containing 6.0 to 40% by weight, preferably 15 to 25% by weight, of the acid and 6.0 to 40% by weight, preferably 15 to 25% by weight of the aldehyde. One example of the aqueous solution of a mixture of the aldehyde and a basic catalyst is that containing 1 to 60% by weight, particularly 12 to 45% by weight, of the aldehyde and 0.2 to 20% by weight, preferably 1 to 10% by weight, of the basic catalyst.

The aldehyde that is most commonly used is formaldehyde, benzaldehyde, hexamethylenetetramine, furfural and mixtures thereof.

The acid catalyst may be any known inorganic and organic acids such as hydrochloric acid, sulfuric acid, nitric acid, acetic acid, oxalic acid, formic acid, orthophosphoric acid, butyric acid, lactic acid, benzenesulfonic acid, p-toluenesulfonic acid or boric acid. Mixtures of these acids may also be used.

The basic catalyst used may be ammonia, ammonium hydroxide and the amines, for example, monoethanolamine and triethyleneamine, a hydroxide or carbonate of a metal selected from the group consisting of the alkali metals and alkaline earth metals, for example, sodium hydroxide, potassium hydroxide, calcium hydroxide, barium hydroxide, or sodium carbonate, and the mixtures thereof. Hexamethylenetetramine can be used not only as the curing agent but also as the basic catalyst.

According to this invention cured phenolic filaments obtained as described above are contacted with a solution or vapor having a concentration of at least 25% by weight of a treating reagent selected from the group consisting of an alcohol of from 1 to 6 carbon atoms, acetone and a mixture thereof.

As specific examples of the foregoing treating reagent, mention can be made of such as methyl alcohol, ethyl alcohol, propyl alcohol, isopropyl alcohol, butyl alcohol, isobutyl alcohol, sec.-butyl alcohol, tert.-butyl alcohol, amyl alcohol, isoamyl alcohol, hexyl alcohol, acetone and a mixture thereof.

The contact between these treating reagents and the cured phenolic filaments can be carried out in either the liquid or vapor state of the reagent. In the case where the reagent is in a liquid or solvent solution state, the contact of the reagent with the filaments can be carried out under reaction conditions either by immersing the filaments in a bath of the reagent, or by causing the filaments to travel through the bath, or by spraying or fuming the filaments with the liquid reagent. On the other hand, when the reagent is in the vapor phase, the contact of the filaments with the reagent may be accomplished by exposing the filaments to the vaporous atmosphere under the reaction conditions. When the reagent is to be used as a solvent solution, it is most commonly used as an aqueous solution but, if desired, other suitable solvents may be used. Whether used in either the liquid or vapor state, the concentration of the treating reagent must be at least 25% by weight, preferably at least 35% by weight, and still more preferably at least 50% by weight. When the concentration is a low one of less than 25% by weight, filaments having a high elongation and in which the variance of elongation is small, as intended by the present invention, cannot be obtained.

The treatment of contacting the treating reagent with the cured phenolic filaments can be carried out in either the filaments' relaxed, tensioned or elongated state. Hence, it is possible to carry out this treatment either before or during the drawing step. The temperature and time of the contacting treatment are suitably chosen in consideration of such factors as the class of the reagent, its concentration, contacting means, etc. When these factors are the same, the treatment time becomes longer as the temperature employed becomes lower. Usually, a temperature ranging from room temperature to about 90° C., is used, for example, a temperature of 25° – 90° C., preferably 30° – 70° C., and a time of the order of 1 – 100 minutes, preferably 5 – 60 minutes.

In accordance with the invention process, the cured phenolic filaments are swelled and relaxed by the treating reagent, and it is presumed that the monomer or the low polymer of aldehydes that may be present in the filaments are extracted and removed by said reagent that is present at the surface of the filaments, with the consequence that the tenacity and elongation are enhanced and the variance of the elongation is reduced. Hence, the operation of drawing is rendered exceedingly smooth. Again, the esterification of the filaments is facilitated and the diffusion into the interior of the filaments of a compound such as acetic anhydride is made easy, with the consequence that not only the acetylation can be completed within in short period of time, but also since a strain is set up inside the filaments, desirable crimps during the step of such as yarn spinning can be developed.

Further, the phenolic filaments obtained by the invention process have a dyeability greatly superior to the conventional phenolic filaments that have not been applied the invention process. The usual phenolic filaments are difficult to dye. For instance, the high temperature dyeing method or the carrier dyeing method by means of disperse dyes as in the case of the dyeing of polyethylene terephthalate filaments does not produce satisfactory results. The phenolic filaments are so difficultly dyeable that it is only when the dyeing is carried out under elevated temperature conditions and moreover by the carrier method that any dye adhesion is discernible. However, the phenolic filaments obtained by the invention method excel in their dyeability in that level dyeings to a deep shape can be obtained under mild conditions.

EXAMPLES 1 – 8 AND CONTROLS 1 – 3

A novolak resin of number average molecular weight of 960 was melt-spun at 160° C., using a spinneret containing 36 holes of 3.0 mm diameter, after which the spun filaments were wound up at the rate of 1,000 meters per minute.

The spun filaments were then immersed in a combined solution of 18% by weight of hydrochloric acid and 18% by weight of formalin, and the temperature was raised from 20° C. to 95° C. within the next 50 minutes. This was followed by water-washing the filaments and thereafter curing the filaments for 40 minutes at 90° C. in 2.8% by weight of ammonia and 33.3% by weight of formalin. The so obtained filaments had a tenacity of 1.25 g/d, an elongation of 23.8% and a Young's modulus of 32.8 g/d.

Next, the foregoing cured phenolic filaments were treated in accordance with the invention process by immersion in aqueous methanol solutions of varied concentrations. The treatment temperature was 55° C., while the treatment time was 40 minutes. The results obtained are shown in the following Table 1.

The "Fluctuation of elongation (%)" used in the table was determined in the following manner.

$$\text{Fluctuation of elongation (\%)} = \frac{\sqrt{\dfrac{\sum_{i=1}^{n} (x_i - \bar{x})^2}{n-1}}}{\bar{x}} \times 100$$

where $x_i$ is measured elongation $\bar{x}$ is average elongation

Table 1

| No. | Methanol concentration (wt %) | Tenacity (g/d) | Elongation (%) | Fluctuation of elongation (%) | Young's modulus (g/d) |
|---|---|---|---|---|---|
| Example 1 | 100 | 1.29 | 66.6 | 11.1 | 33.6 |
| Example 2 | 90 | 1.26 | 64.8 | 13.1 | 33.8 |
| Example 3 | 80 | 1.38 | 70.1 | 9.8 | 35.1 |
| Example 4 | 70 | 1.25 | 72.6 | 10.3 | 34.8 |
| Example 5 | 60 | 1.46 | 77.3 | 7.6 | 32.6 |
| Example 6 | 50 | 1.38 | 67.2 | 5.4 | 35.4 |
| Example 7 | 35 | 1.30 | 64.4 | 12.2 | 31.8 |
| Example 8 | 25 | 1.54 | 52.6 | 15.8 | 34.3 |
| Control 1 | 15 | 1.33 | 26.2 | 39.0 | 32.2 |
| Control 2 | 10 | 1.31 | 27.6 | 51.9 | 34.4 |
| Control 3 | 0* | 1.27 | 25.4 | 93.0 | 33.1 |

Note.
*Treatment was carried out using only water.

As is apparent from Table 1, when the concentration of methanol is at least 25% by weight, filaments having a high elongation and moreover of small fluctuation of elongation can be obtained without a reduction of the tenacity. But when the concentration of methanol is less than 25% by weight, only those of low elongation and moreover of great fluctuation are obtained.

Further, the foregoing treated filaments were in all cases infusible and noncombustible, and none of their inherent characteristics were impair in the least.

EXAMPLES 9 – 14 AND CONTROLS 4 – 14

A novolak of a number average molecular weight of 880 obtained by the polycondensation of 50% by weight of m-cresol and 50% by weight of phenol with formaldehyde in the presence of an oxalic acid catalyst was melt-spun as in Example 1.

The resulting spun filaments were then immersed in a solution of 18 weight % hydrochloric acid and 18 weight % formalin, after which the temperature was raised from 20° to 95° C. within the next 6 hours. The reaction was then continued for 6 hours while maintaining the temperature of 95° C.

The so obtained cured phenolic filaments had a tenacity of 1.30 g/d, an elongation of 7.2%, and a Young's modulus of 33.6 g/d.

Next, the foregoing cured phenolic filaments were treated in accordance with the invention process, using various treating reagents. The treatment temperature was 60° C., while the treatment time was 40 minutes. The results obtained are shown in the following Table 2.

Table 2

| No. | Treating reagent (100 %) | Tenacity (g/d) | Elongation (%) | Fluctuation of elongation (%) | Young's modulus (g/d) |
|---|---|---|---|---|---|
| Example 9 | methanol | 1.38 | 56.5 | 8.6 | 33.4 |
| Example 10 | ethanol | 1.34 | 47.4 | 14.8 | 34.1 |
| Example 11 | propanol | 1.39 | 40.5 | 25.7 | 33.6 |
| Example 12 | butanol | 1.31 | 35.4 | 25.4 | 35.1 |
| Example 13 | n-amyl alcohol | 1.30 | 36.1 | 26.3 | 34.8 |
| Example 14 | acetone | 1.29 | 46.8 | 28.6 | 30.5 |
| Control 4 | dioxane | 1.32 | 19.6 | 68.5 | 30.7 |
| Control 5 | dimethylformamide | 1.30 | 10.6 | 44.2 | 33.3 |
| Control 6 | dimethylacetamide | 1.24 | 11.4 | 39.9 | 31.6 |
| Control 7 | tetrahydrofuran | 1.26 | 9.6 | 73.1 | 33.9 |
| Control 8 | ammonia (1 weight %) | 1.32 | 20.4 | 49.6 | 34.1 |
| Control 9 | sodium hydroxide (") | 1.09 | 13.8 | 20.8 | 29.8 |
| Control 10 | potassium hydroxide (") | 1.11 | 19.4 | 49.6 | 27.7 |
| Control 11 | sulfuric acid (") | 1.23 | 9.7 | 86.4 | 33.1 |
| Control 12 | hydrochloric acid (") | 1.28 | 11.5 | 74.1 | 32.6 |
| Control 13 | acetic acid (") | 1.31 | 8.9 | 68.9 | 34.6 |
| Control 14 | water | 1.31 | 7.6 | 63.6 | 33.7 |

As is apparent from Table 2, when methanol, ethanol, propanol, butanol, n-amyl alcohol and acetone have been used as the treating reagent, the fluctuation of elongation is small and moreover the elongation of the resulting filaments is high, the effects being especially pronounced in the case of methanol.

On the other hand, in the case of the solvents other than those mentioned above, it was not possible to obtain a high elongation and moreover a small fluctuation of the elongation.

EXAMPLE 15 AND CONTROL 15

90% by weight of a novolak of a number average molecular weight of 960 and 10% by weight of 6-nylon were melt-blended, after which the resulting melt was melt-spun as in Example 1 followed by curing the spun filaments.

The so obtained cured phenolic filaments had a tenacity of 1.45 g/d, an elongation of 14.8% and a Young's modulus of 31.3 g/d.

The foregoing filaments were treated for 30 minutes at 60° C. with a 55 weight % aqueous methanol solution. As control, the foregoing filaments were treated for 6 hours at 70° C. with a 1 weight % aqueous ammonia solution. After water-washing and drying the foregoing filaments, they were each acetylated for 10 minutes at 135° C. in a combined solution consisting of 99.5 weight % acetic anhydride and 0.5 weight % concentrated sulfuric acid (98 weight %). The results obtained are shown in Table 3, below.

Table 3

| Experiment No. | Treatment before acetylation treatment | Weight increase (wt%) | Color tone | Tenacity (g/d) | Elongation (%) |
|---|---|---|---|---|---|
| Example 15 | 55 wt% methanol | 27.6 | white | 1.23 | 63.2 |
| Control 15 | 1 wt% ammonia | 2.1 | brown | 1.41 | 26.4 |

As is apparent from Table 3, the cured phenolic filaments that were treated with methanol in accordance with the invention process yielded filaments which not only demonstrated a great increase in weight by the acetylation but also were white in color and had an exceedingly satisfactory elongation. In contrast, in the case of the filaments treated with ammonia by way of comparison, difficulty was experienced in their acetylation and, in addition, they were not only disclosed to a brown color, but also their elongation was low.

EXAMPLE 16

After spinning the filaments and curing same as in Example 1, the cured filaments were treated for 30 minutes at 20° C. with a 55 weight % aqueous methanol solution.

The so obtained filaments were then cold drawn to either 20%, 40% or 50% at 20° C. and wet-heat drawn to either 30%, 60% or 80% at 55° C. in an aqueous methanol solution. A pulling speed of 6 meters per minute was used in each instance.

In Table 4 are shown the tenacities and elongations of the cured filament, the cured filament after treatment and the filament after having been drawn by the above-described methods, and in each case also shown are the number of filament breakages of yarns composed of 36 ends.

Table 4

| Treatment method | Tenacity (g/d) | Elongation (%) | Filament breakage (ends) |
|---|---|---|---|
| Cured filament | 1.25 | 23.8 | — |
| Methanol treated after cure | 1.33 | 70.8 | — |
| Above methanol-treated filament cold drawn 20 % | 1.70 | 88.6 | 0 |
| " 40 % | 2.58 | 52.1 | 0 |
| " 50 % | 3.05 | 38.7 | 0 |
| Above methanol-treated filament wet-heat drawn 30 % | 1.96 | 48.5 | 0 |
| " 60 % | 2.86 | 21.6 | 0 |
| " 80 % | 3.94 | 14.7 | 0 |

As is apparent from Table 4, the filaments treated with methanol have a high elongation and can be drawn to a high ratio. Hence, the filaments thus obtained have high tenacity and high residual elongation.

EXAMPLE 17 AND CONTROL 16

Phenolic filaments treated with a 60 weight % aqueous methanol solution in accordance with the invention method (Example 5) and the same filaments not given the methanol treatment (Control 3) were dyed using as the dye Duranol Blue Green B 300 (produced by I. C. I.) in an amount of 10% o.w.f. and as the carrier IP Carrier — E (produced by Ipposha Resin Company, Japan). Using the carrier at a concentration of 4 cc/liter and a bath ratio of 50 times (50 weight parts of the dye liquor per weight part of fiber) the dyeing was carried out under the following varied conditions. As a result, the rates of dye exhaustion (%) shown in Table 5 were obtained.

Table 5

| Experiment No. | | | Example 17 | Control 16 |
|---|---|---|---|---|
| Dyeing conditions: | Temperature (° C.) | Time (min) | | |
| | 98 | 30 | 20.6 % | 5.1 % |
| | 98 | 60 | 31.4 | 9.6 |
| | 130 | 10 | 58.2 | 25.4 |
| | 130 | 60 | 65.3 | 32.6 |

Further, in all cases the dye adhesion of the control filaments was not level, whereas the filaments obtained by the invention process could be dyed levelly in all instances.

What is claimed is:

1. A process for producing melt-spun and cured phenolic undrawn filaments consisting essentially of a fiber-forming polyamide resin selected from the group consisting of nylon-6, nylon-7, nylon-9, nylon-11, nylon-12, nylon-66, nylon-610, nylon-611, nylon-612, nylon-6T, nylon-11T and a copolyamide consisting essentially of these polyamides in the amount of less than 50% by weight based on the total weight of the filaments and a novolak resin in the amount of not less than 50% by weight based on the total weight of the filaments having improved drawability which comprises melt-spinning a fiber-forming novolak resin containing less than 50% by weight of said resin mixture of said polyamide resin, curing the resulting filaments with an aldehyde in the presence of a basic or acid catalyst, and contacting said cured phenolic filaments with at least 25% by weight of a treating reagent in a vapor or liquid phase and selected from the group consisting of methanol and ethanol and a mixture thereof.

2. The process according to claim 1 wherein the concentration of said treating reagent is at least 35% by weight.

3. The process according to claim 1 wherein the contact of the filaments with the treating reagent is carried out at a temperature ranging from room temperature to about 90° C.

4. A process for producing melt-spun and cured phenolic undrawn filaments consisting essentially of nylon-6 in the amount of less than 50% by weight based on the total weight of the filaments and a novolak resin in the amount of not less than 50% by weight based on the total weight of the filaments having improved drawability which comprises melt-spinning a fiber-forming novolak resin containing less than 50% by weight of said resin mixture of said nylon-6, curing the resulting filaments with an aldehyde in the presence of a basic or acid catalyst, and contacting said cured phenolic filaments with at least 25% by weight of a treating reagent in a vapor or liquid phase and selected from the group consisting of methanol and ethanol and a mixture thereof.

* * * * *